US005702098A

United States Patent [19]

Gottlieb et al.

[11] Patent Number: 5,702,098

[45] Date of Patent: Dec. 30, 1997

[54] ENVELOPE CLOSING AND SEALING APPARATUS

[75] Inventors: Robert K. Gottlieb, Milford, Conn.; Richard A. Grossman, Cicero, Ill.; Michael R. Ifkovits, Danbury; Philip G. Ruess, Norwalk, both of Conn.

[73] Assignee: Pitney Bowes Inc., Stamford, Conn.

[21] Appl. No.: 733,383

[22] Filed: Oct. 18, 1996

[51] Int. Cl.[6] ..... B65H 39/02

[52] U.S. Cl. ..... 270/58.06

[58] Field of Search ..... 270/32, 45, 58.01, 270/58.06

[56] References Cited

U.S. PATENT DOCUMENTS

| | | | |
|---|---|---|---|
| 5,029,832 | 7/1991 | Orsinger et al. | 270/58.06 |
| 5,127,640 | 7/1992 | Orsinger et al. | 270/58.06 X |
| 5,478,063 | 12/1995 | Linder et al. | 270/58.06 |

*Primary Examiner*—Hoang Nguyen

*Attorney, Agent, or Firm*—Christopher J. Capelli; Melvin J. Scolnick; Robert Meyer

[57] ABSTRACT

An apparatus is disclosed for closing and sealing the flaps of envelopes that have passed through an inserting machine in which collations of insert material have been inserted into the envelopes, and for detecting whether or not certain envelopes cannot be properly closed and sealed and for separating such envelopes from those that are properly closed and sealed. The apparatus is constructed and arranged such that if insert material is improperly inserted into the envelope such that the flap cannot turn freely about the crease line that connectes the flap to the envelopem, the flap will remain substantially in the flat, extended position it occupies when the envelope enters the closing and sealing apparatus. That position of the flap is sensed and the envelope is then diverted from the normal path of properly closed and sealed envelopes into a collection bin for retreival by an operator.

6 Claims, 4 Drawing Sheets

ENVELOPE CLOSING AND SEALING APPARATUS

BACKGROUND OF THE INVENTION

This invention relates generally to the field of envelope handling apparatus, and more particularly to an apparatus for closing and sealing the flaps of envelopes traveling along a feed path after insert material has been inserted into the envelopes by an inserting machine.

Envelope inserting machines have long been well known and are utilized in a large variety of document processing applications which involve inserting one or more items into an envelope for further handling, such as mailing. One particular application where these machines are used involves high speed collating machines which store a plurality of different types of insert material which are added to a basic document that is traveling along an elongate feed, at the end of which the basic document and the insert materials are formed into collations which are inserted into envelopes. One typical example of such an application is the mailing of monthly statements to customers from bank credit card operations, telephone or other utility companies, book clubs, catalog mail order companies, and many other types of business operations in which various material is mailed to tens or perhaps hundreds of thousands of customers each month.

These examples involve a typical document handling process in which a basic document, such as the monthly invoice to customers, is computer printed on forms passed through a high speed computer printer in continuous web form, and are then fed through a suitable separating machine and entered into the feed path of a collating machine. The collating machine then adds any desired number of other documents, such as advertising material, services information brochures, announcements of forthcoming services, sweepstakes entries, etc., to the basic document as the latter travels along the feed path of the collation machine. All of the collated material may be passed through an accumulator or other device that arranges the material in a precisely aligned packet which is then fed to an inserting machine where the packet is inserted into an envelope which is suitably held at an inserting station. After the packet of documents is inserted into the envelope, it is typically fed through a machine which moistens the envelope flap, turns it 180° and presses it against the back of the envelope to seal it thereto. The now closed and sealed envelope is then typically fed either through a postage metering machine for printing a postage indicia on the envelope or may be fed directly to suitable stacking device for further processing.

The problem that arises is that occasionally a collation of insert material is inserted into an envelope out of proper alignment with the envelope, or the individual documents of the collation are not properly aligned so that the collation cannot fit properly within the envelope, or even a properly aligned collation is not fully inserted into the envelope. In any of these situations, the result is that a marginal portion of the insert material is disposed above the crease line which joins the sealing flap to the main body of the envelope, thereby preventing the flap from being turned through the approximately 180° angle to permit the flap to be sealed against the back surface of the envelope. The marginal portion of the insert material collation may be either just a corner portion if the collation is inserted at an angle, or a lengthy marginal portion if the collation is inserted in longitudinal alignment with the envelope, but but the collation is out of alignment or it is not inserted far enough for the trailing edge of the collation to be disposed beyond the crease line. In either event, when the envelope passes through the envelope flap closing and sealing apparatus, the flap cannot rotate evenly about the crease line. If the collation is inserted at an angle with just a corner portion protruding beyond the crease line, the flap is unevenly folded and the envelope then jams in the closing and sealing apparatus. The entire inserting machine then shuts down until an operator clears the jam, with the result that the overall output of the inserting apparatus is substantially reduced, since in a typical situation, about 300 envelopes could have been processed in the time required for an operator to clear the jam.

On the other hand, if the insert material is inserted in longitudinal alignment with the envelope but not fully inserted, the flap may fold over evenly but not along the crease line, with the result that the moistened adhesive on the edge of the flap will bond to the insert material, not to the rear surface of the envelope, thereby preventing the envelope from being opened without the likelihood of tearing the insert material. Since the envelope in this condition may not jam in the closing and sealing appaaratus, but rather continues on in the stream of envelopes, such improperly sealed envelopes reach their destination in this condition, which is generally an entirely unacceptable result.

Thus, there is a need for a machanism that will detect whether insert material has been properly inserted into envelopes moving through the flap closing and sealing mechanism of high speed inserting apparatus, and which will both prevent the flap of any envelope containg improperly inserted material from being turned to the sealing position and also eject such envelope from the main stream of envelopes and direct it into a collection bin from which it can be retrieved by an operator, all while maintaining continuity of operation of the inserting apparatus.

BRIEF SUMMARY OF THE INVENTION

The present invention substantially obviates, if not entirely eliminates, the above shortcomings and other disadvantages of current envelope flap closing and sealing devices by providing an envelope flap closing and sealing apparatus which prevents the flaps of envelopes which contain improperly inserted insert material from being turned and sealed, and which ejects such envelopes from the feed path thereof, thereby preventing jams which would shut down the inserting apparatus or causing flaps to seal to the insert material. It has been descovered that if the rigid flap engaging bar which normally forces the flap downwardly to commence the approximately 180° turning movement of the flap is replaced with an elongate strip of very thin, flexible material which has insufficient regidity to commence the turning movement of the flaps is there is any impediment to free turning movement of the flaps, the flaps that are obstructed from free turning movement can be maintained in a flat orientation, and this orientation can be sensed to cause operation of a diverting mechanism to thus divert that envelope from the normal feed.

Thus, the principles of the present invention are embodied in an apparatus for closing and sealing the flaps of envelopes that have passed through an inserting machine in which collations of insert material have been inserted into the envelopes, and for detecting whether or not certain envelopes cannot be properly closed and sealed, and for separating such envelopes from those that are properly closed and sealed. In that environment, and in its broader aspects, the apparatus comprises means defining a feed path along which envelopes are fed into the flap closing and sealing apparatus from an inserting machine, and means for feeding envelopes along the feed path with the flaps thereof lying in the plane of the envelopes in an extended positon beyond the crease line of the envelopes. There is means disposed in the feed path for normally turning the flaps through approximately 180° along the crease line to substantially close the flaps against the rear surface of the envelopes, and for maintaining the flaps in the extended position if the flaps encounter any resistance to being turned freely about the crease line. A detecting means is disposed in the feed path for detecting the presence of an envelope with the flap having been maintained in the extended position. Finally, there is means responsive to operation of the detecting means detecting an envelope with the flap lying in the extended position for ejecting such envelope from the feed path, with the result that envelopes with improperly closed flaps are diverted from the feed path and are accessible for manual retrieval without otherwise affecting the operation of the envelope closing and sealing apparatus.

In some of its more limited apects, the means for normally turning the flaps through the approximately 180° along the crease line and for maintaining the flaps which cannot be turned freely in the extended position comprises a first flap engagng member mounted in the feed path in overlying relationship to the flaps when they are lying in the extended position, for exerting a sufficiently light downward force on the flaps to commence the turning movement thereof if the turning movement is not obstructed so that said flap can turn freely, and a second flap engaging member mounted adjacent the first flap engaging member and in operative association therewith such that the second flap engaging member completes the turning movement of the flaps if the first flap engaging member has caused the flaps to turn through a portion of the 180° movement. The first flap engaging member is a strip of resilient material which as only sufficient rigidity to turn the flap if it is not obstructed by insert material projecting beyond the crease line of the flap.

The apparatus includes a detecting device which can detect whether or not the flap of an envelope has been turned, and if not, the detecting device actuates a pivotable gate in the feed path of the envelopes to divert any envelope on which the flap has not been properly turned and sealed from the normal feed path so that the envelope can be retrieved, adjusted as to the position of the insert material and reinserted into the feed path, all without interruption in the continuity of operation of the closing and sealing apparatus or any other machine or component in the overall process.

Having briefly described the general nature of the present invention, it is a principal object thereof to provide an envelope closing and sealing apparatus which can detect the presence of an unsealable envelope and eject that envelope from the mainstream of envelopes to prevent an envelope jam and machine shutdown.

It is another object of the present invention to provide an envelope closing and sealing apparatus which detects the presence of an unsealable envelope by maintaining the envelope flap in an open, extended position so that the envelope can be retrieved, the contents adjusted and the envelope reinserted into the mainstream of envelopes, again without an envelope jam or machine shutdown.

It is a further object of the present invention to provide an envelope closing and sealing apparatus which is relatively simple and inexpensive in construction, operates at a high rate of speed and is highly reliable.

These and other objects and features of the present invention will be more apparent from an understanding of the following detailed description of a presently preferred mode of carrying out the invention when considered in conjunction with the accompanying drawings.

DETAILED DESCRIPTION OF THE INVENTION

Figure 1:
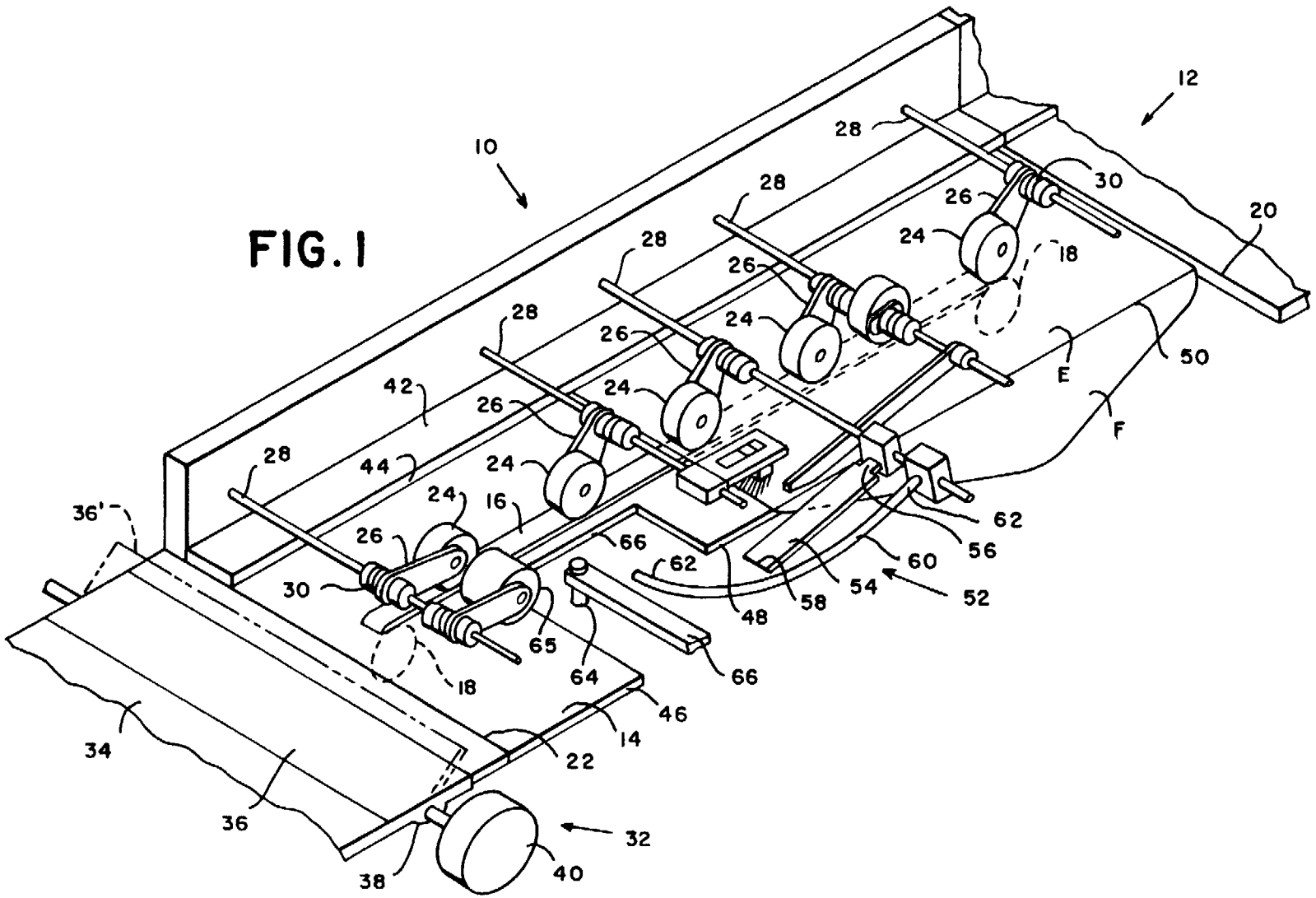
FIG. 1 is a perspective view of the envelope flap closing and sealing apparatus of the present invention, showing an envelope entering the apparatus with the flap lying open in an extended postion.

Referring now to the drawings, and particularly to FIG. 1 thereof, the reference numeral 10 indicates generally the flap closing and sealing apparatus of the present invention. The reference numeral 12 indicates generally the discharge end of a conventional envelope inserting machine which feeds one or more documents from individual feeders and either inserts a succession of single documents into envelopes, or forms a succession of collations of a plurality of documents and inserts the collations into envelopes. Since the details of the inserting machine form no part of the present invention, further description thereof is not deemed necessary for a full understanding of the present invention, other than to note that the envelope feeding device of the inserting machine delivers the envelopes with the insert material therein to the infeed end of the envelope closing and sealing apparatus 10 of the present invention.

Thus, the apparatus 10 includes a frame which supports in a suitable manner all of the parts of the apparatus, including an elongate plate 14 which provides a flat supporting surface for envelopes E which are fed through the apparatus 10 by a conveyor belt 16 which is suitably mounted on drive pulleys 18 which in turn are suitably mounted on the frame adjacent the infeed end 20 and the outfeed end 22 of the apparatus 10. A plurality of pressure rollers 24 are rotatably mounted on arms 26 which are pivotally Connected to rods 28 suitably mounted on the frame so that the rollers 24 are directly over the conveyor belt 16. A suitable spring 30 mounted on each rod 28 and bearing on the arms 26 causes the rollers 24 to apply sufficient pressure to the upper surface of the envelope E so that the conveyor belt 16 moves the envelope E through the apparatus 10 for closure or non-closure of the flap, as the case may be, as fully described below.

The reference numeral 32 indicates generally an envelope diverting mechanism which, when activated, diverts an envelope from the main feed path of envelopes which have been closed and sealed by the apparatus 10. Thus, the diverting mechanism has a supporting plate 34 which abuts the outfeed end 22 of the support plate 14 of the apparatus 10 and, in effect, forms an extension thereof. The plate 34 includes a movable gate 36 which is pivotally connected to the plate 34 as indicated by the reference numeral 38. A suitable actuator 40, such as a rotary solenoid, is connected to the gate 38 so that when the solenoid is energized, the gate 36 is rotated from the flat, solid line position shown in FIG. 1 to the raised dotted line position 36'. It will be apparent that when the gate 36 is in the flat position, an envelope E being fed out of the apparatus 10 by the conveyor belt 16 will pass over the gate 36 and be conveyed by another suitable conveyor means to the next processing machine or component in the overall envelope handling system, which may, for example, be a mailing machine which prints a postage indicia on the now sealed envelope. However, if the gate 36 is in the raised position 36', an envelope will be intercepted by the gate 36 and diverted downwardly out of the normal feed path of envelopes moving along the supporting plate 34. In practice, a suitable collection bin (not shown) would be mounted beneath the opening formed by the gate 36 when in the raised position 36' to collect and store any envelopes that are diverted from the main feed path.

Still referring to FIG. 1, the support plate 14 for the apparatus 10 includes a suitable registration member 42 which provides a registration guide 44 which the bottom edge of envelopes passing through the apparatus 10 engage to properly align the envelopes with the flap closing mechanism now to be described. The outer edge 46 of the support plate 14 is cut back over a major portion of the length of the apparatus 10, as indicated by the reference numeral 48, so that this edge 48 is disposed directly under the crease line 50 of the envelope E which separates the body of the envelope E from the flap F connected thereto. Although not shown, in practice the registration member 42 would be laterally adjustable to move the registration guide 44 to accommodate envelopes of different height.

Figure 2:
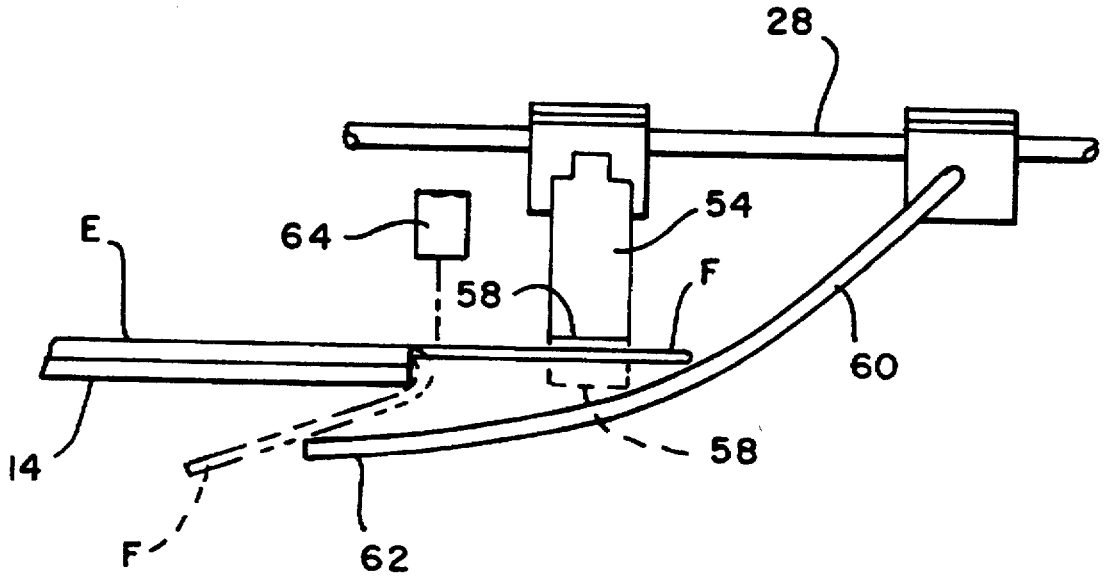
FIG. 2 is a fragmentary side view of the apparatus shown in FIG. 1 illustrating the vertically spaced relationship of the envelope flap turning mechanism.

With reference now to FIGS. 1 and 2, the reference numeral 52 indicates generally a flap turning mechanism which is disposed in the envelope feed path extending through the apparatus 10 for normally turning the flap F through approximately 180° along the crease line 50 to substantially close the flap against the rear surface of the envelope E, and for maintaining the flap F in an open or extended position if the flap encounters any resistance to being turned freely about the crease line 50. Thus, the flap turning mechanism 52 comprises a first flap engaging member 54 which is an elongate strip of flexible material having one end 56 thereof suitably mounted on one of the rods 28 so that the member 54 extends generally parallel to the edge 48 of the support plate 14 and in overlying relationship with the flap F as the envelope E passes through the apparatus 10. The other end 58 of the member 54 is normally disposed slightly below the plane of the support plate 14, as best seen in FIG. 2, so that it bears lightly on the upper surface of the flap F and exerts a light downward force on the flap F as the envelope E is moved along the support plate 14, the degree of regidity of the material from which the member is formed being insufficient to commence the turning movement of the flap F about the crease line 50 if the flap F encounters any resistance to turning by improperly inserted insert material projecting from the enveloope E byond the crease line 50. This is clearly shown in FIG. 2, and further explained below in the description of operation of the apparatus 10.

The flap turning mechanism 52 also includes a second flap engaging member 60 which is mounted in operative association with the first flap engaging member 54 such that the second flap engaging member 60 completes the turning movement of the flap F if the first flap engaging member 54 has been able to commence the turning movement of the flap F. The second flap engagement member 60 is in the form of an elongate rod, one end 62 of which is mounted adjacent to the end 56 of the first flap engaging member 54, the rod having a relatively straight portion 61 extending longitudinally and generally parallel to the first flap engaging member 54 for approximately the length thereof. The rod 60 further includes a curved portion 62 which curves laterally inwardly toward the envelope E and which lies in a plane just below the plane of the envelope E, so that the lead edge of the flap F adjacent the juncture thereof with the envelope E at the crease line 50 passes over the curved portion 62 of the bar 60 so as to urge the flap through the remaining portion of the 180° movement as the remainder of the flap passes over the curved portion 62 of the bar 60. This briefly described procedure would be the normal operation of the flap turning mechanism 52 if the insert material has been properly inserted into the envelope E by the inserting machine 12 and therefore offers no resistance to turning of the flap F abut the crease line 50. This will also be further described below in connection with the operation of the apparatus 10.

However, in the event that the insert material is not properly inserted into the envelope, and a portion of it projects slightly beyond the crease line 50, the flap F is not free to turn about the crease line 50 since the turning motion of the flap F is obstructed by the insert material. In this event, the first flap engaging member 54 cannot depress the flap F since, as stated above, it does not have sufficient rigidity to do so when improperly inserted insert material is projecting beyond the crease line 50, and the flap remains in the flat, extended position shown in FIG. 3, as mere fully explained below.

The apparatus 10 is provided with a detecting device 64 which is mounted on a suitable bracket 66 in the feed path of the envelopes in position to detect the presence of an envelope E in which the flap F has not been turned and remains in the flat extended position. The detecting device 64 may be any type of device, such as a photo detector, which can detect the present of an extended flap F since the line of sight of the detector 64 is slightly beyond the path of movement of the crease line 50 as it moves along the edge 48 of the support plate 14. The support plate 14 has a further inward depression 66 to permit the flap F to fold under and make contact with the reverse side of the envelope E. The detector 64 is appropriately connected to the actuator 40 so that when it detects the presence of a flap F, it actuates the actuator 40 to open the gate 36.

Figure 3:
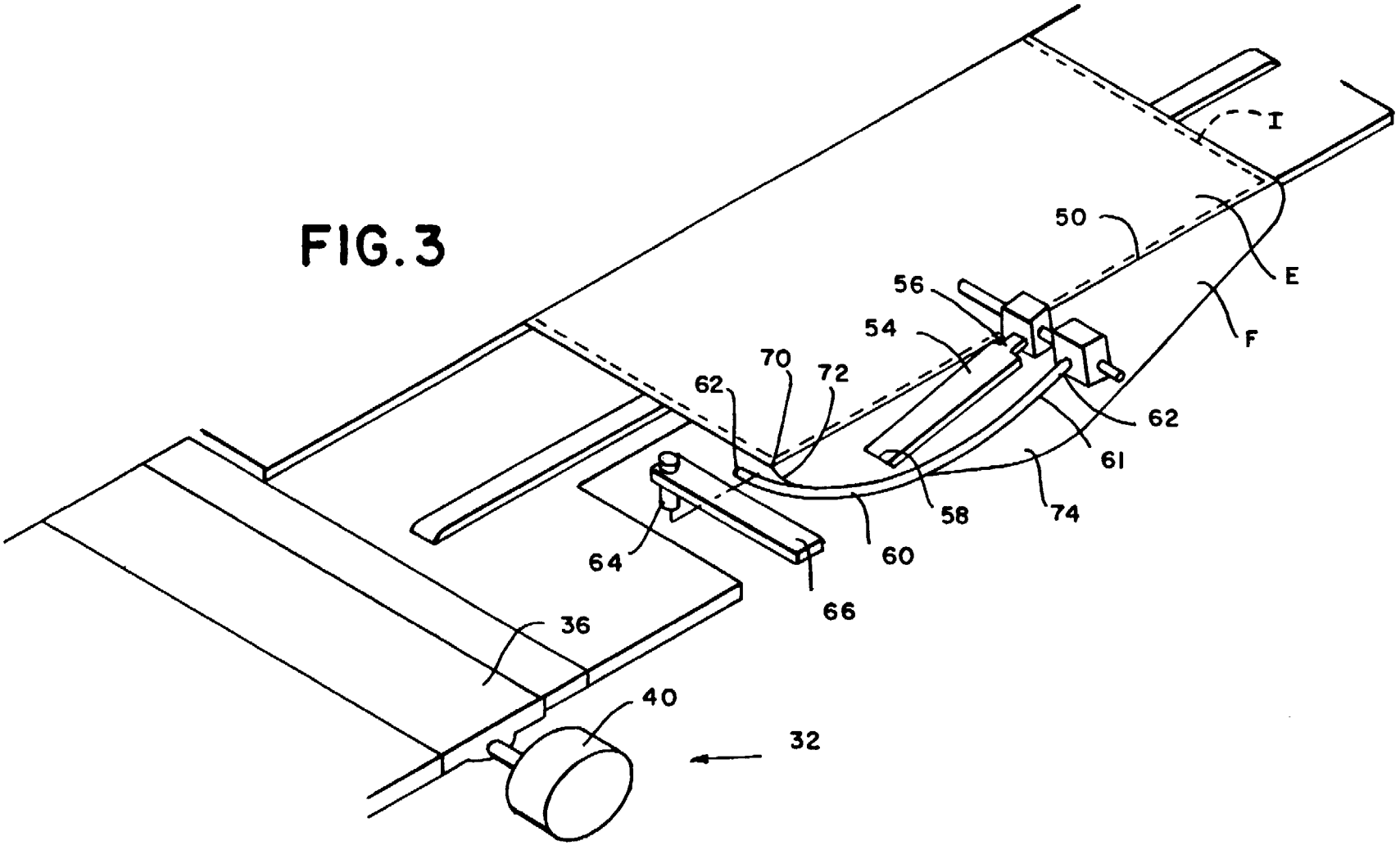
FIG. 3 is a fragmentary perspective view of the apparatus shown in FIG. 1 showing an envelope with insert material properly inserted therein and the flap in a partial stage of closure.

The operation of the apparatus 10 will now be described. With reference to FIGS. 1 and 3, assume that an envelope E is fed into the apparatus 10 from the inserting machine 12 which has insert material properly inserted therein, as indicated in FIG. 3 by the dash line rectangle indicated by the reference letter I within the outline of the envelope E. As the envelope E is fed through the apparatus 10 by the conveyor belt 16 and pressure rollers 24, the first flap engaging member 54 begins to bear on the upper surface of the flap F, as seen in FIG. 3, and thereby exerts a downward force of relatively small magnitude on the flap F to urge it downwardly in a rotating motion about the crease line 50. With the flap F thus partially depressed, when the lead edge corner 70 of the flap F and crease line 50 approach the curved portion 62 of the rod 60, the portion 72 of the outer edge of the flap F that is immediately adjacent to the lead edge corner 70 is slightly above the curved portion 62 of the rod 60, and the remaining portion 74 of the outer edge is slightly below the straight portion 61 of the rod 60. Upon further movement of the envelope E, the remaining portion 72 of the outer edge of the flap F rides over the curved portion 62 of the bar 60 which causes the entire flap F to progressively turn through the approximately 180° angle to bring the flap into juxtaposition with the rear surface of the envelope E. In this situation, as the envelope E continues to move, the detecting device 64 does not detect the presence of the flap F since it is out of range of the detecting device 64, with the result that the actuator 40 for the gate 36 is not activated and the gate 36 remains in the flat position to permit the envelope E to pass over it and on into the next processing machine. As the envelope E with the flap F in closed position moves past the detecting device 64, a sealing roller assembly 65 presses the moistened adhesive on the flap F into engagement with the rear surface of the envelope E to seal the flap F thereto in known manner.

Figure 4:
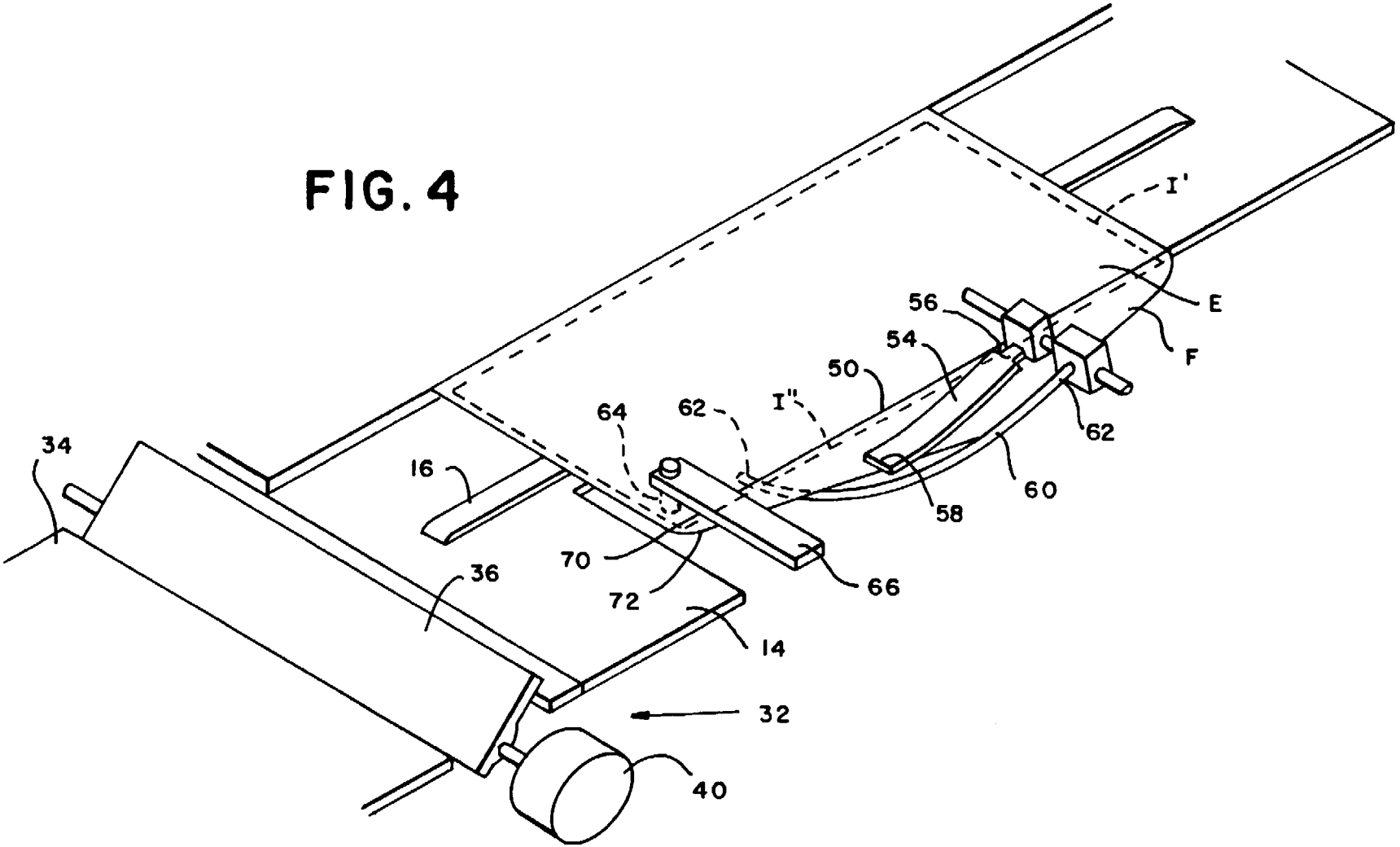
FIG. 4 is a view similar to FIG. 2 but showing an envelope in which the insert material is not fully inserted into the envelope so as to prevent the flap from closing, with the flap turning mechanism now maintaining the flap in the flat, extended position.

With reference now to FIGS. 1 and 3, assume that an envelope E is fed into the apparatus 10 from the inserting machine 12 which has insert material improperly inserted therein, as indicated in FIG. 4 by the dash line rectangle indicated by the reference letter I', so that a portion of the insert material I' is projecting slightly out of the envelope E beyond the crease line 50, as indicated in FIG. 4 by the dash line I". In this situation, as the envelope E is fed through the apparatus 10 by the conveyor belt 16 and pressure rollers 24, the first flap engaging member 54 again begins to bear on the upper surface of the flap F, as seen in FIG. 4, and still exerts a downward force on the flap F to urge it downwardly about the crease line 50. However, since a portion of the insert material I" is extending beyind the crease line 50, the flap cannot turn freely about the crease line 50 and therefore remains substantially in the flat extended position shown in FIGS. 1 and 4, and the fexible strip 54 simply bends upwardly and rides over the flap F. As the envelope E moves forwardly, the portion 72 of the outer edge of the flap F is again slightly above the curved portion 62 of the rod 60, but the remaining portion 74 of the outer edge remains slightly above the straight portion 61 of the rod 60. Upon further movement of the envelope E, the portion 72 of the outer edge of the flap F still rides over the curved portion 62 of the bar 60, but since the flap F is still in the flat extended position, the entire flap now rides over the rod, as seen in FIG. 4. In this situation, the envelope E continues to move, the detecting device 64 detects the presence of the flap F since it is lying within the range of the detecting device 64, with the result that the actuator 40 for the gate 36 is activated and the gate 36 is pivoted upwardly so as to project into the path of movement of the envelope, and the envelope E is diverted downwardly from the normal feed path into a bin or other collection instrumentality. And this occurs without interruption in the operation of the closing and sealing apparatus 10 or any other machine or component in the processing system.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. Apparatus for closing and sealing the flaps of envelopes that have passed through an inserting machine in which collations of insert material have been inserted into the envelopes, and for detecting whether or not certain envelopes cannot be properly closed and sealed and for separating such envelopes from those that are properly closed and sealed, said apparatus comprising A. means defining a feed path along which envelopes are fed into said flap closing and sealing apparatus from an inserting machine, B. means for feeding envelopes along said feed path with the flaps thereof lying in the plane of said envelopes in an extended positon beyond the crease line of the envelopes, C. means disposed in said feed path for normally turning said flaps through approximately 180° along said crease line to substantially close said flaps against said rear surface of said envelopes, and for maintaining said flaps in said extended position if said flaps encounter any resistance to being turned freely about said crease line, D. detecting means disposed in said feed path in position to detect the presence of an envelope with said flap having been maintained in said extended position, and E. means responsive to operation of said detecting means detecting an envelope with said flap lying in said extended position for ejecting such envelope from said feed path, whereby envelopes with improperly closed flaps are ejected from said feed path and are accessible for manual retrieval without otherwise affecting the operation of the envelope closing and sealing apparatus.

2. An apparatus as set forth in claim 1 wherein said means for normally turning said flaps through 180° along said crease line and for maintaining said flaps which cannot be turned freely in said extended position comprises A. first flap engaging means mounted in said feed path in overlying relationship to said flaps when lying in said extended position for exerting a sufficiently light downward force on said flaps to commence said turning movement thereof only if said turning movement is not obstructed so that said flap can turn freely, and B. second flap engaging means mounted adjacent said first flap engaging means and in operative association therewith such that said second flap engaging means completes said turning movement of said flaps if said first flap engaging means has caused said flaps to turn through a portion of said 180° movement.

3. An apparatus as set forth in claim 2 wherein said first flap engaging means comprises an elongate strip of flexible material having one end thereof mounted in overlying relationship with said flaps and the other end bearing lightly on the upper surface of said flaps so as to exert said light downward force as said envelopes are moved along said feed path, the degree of regidity of said strip being insufficient to commence said turning movement of said flaps if they encounter any resistance to turning along said crease line.

4. An apparatus as set forth in claim 3 wherein said second flap engaging means comprises an elongate flap turning bar having one end thereof mounted adjacent said feed path and extending longitudinally thereof along said flexible strip, said flap turning bar having a free end portion which curves laterally inwardly toward said envelope and lies in a plane just below the plane of said envelope so that the lead edge of said flap adjacent the juncture thereof with said envelope at said crease line passes over said curved portion of said bar so as to urge said flap through the remaining portion of said 180* as the remainder of said flap passes over said curved portion of said bar.

5. An apparatus as set forth in claim 1 wherein said ejecting means comprises

A. diverting means disposed in said feed path for alternately permitting an envelope to continue in said feed path and exit from said closing and sealing apparatus and obstructing the free movement of an envelope along said feed path and diverting said envelope from said feed path if the flap thereof cannot be freely turned about said crease line and B. means responsive to operation of said detecting means detecting that the flap of an envelope is retained in said extended position for activating said diverting means to divert said envelope from said path of travel.

6. An apparatus as set forth in claim 5 wherein said diverting means comprises an enlgate gate normally lying in said path of travel so that closed and sealed envelopes can pass thereof, said gate being pivotably mounted in said feed path so as to pivot upwardly into said feed path to divert envelopes downwardly from said feed path in response to said operation of said means for activating said diverting means.

* * * * *